US007299744B2

(12) United States Patent
Charvet

(10) Patent No.: US 7,299,744 B2
(45) Date of Patent: Nov. 27, 2007

(54) PACKAGING OF TIRES IN HIGH STACKS

(75) Inventor: Paul Charvet, Veyre-Monton (FR)

(73) Assignee: Michelin Recherche et Technique S.A., Granges-Paccot (CH)

( * ) Notice: Subject to any disclaimer, the term of this patent is extended or adjusted under 35 U.S.C. 154(b) by 341 days.

(21) Appl. No.: 11/011,613

(22) Filed: Dec. 15, 2004

(65) Prior Publication Data

US 2005/0184450 A1 Aug. 25, 2005

(30) Foreign Application Priority Data

Dec. 17, 2003 (FR) ..... 03 14963

(51) Int. Cl.
*B65B 13/20* (2006.01)

(52) U.S. Cl. ..... 100/2; 100/26; 53/399

(58) Field of Classification Search ..... 100/1, 100/2, 3, 8, 12, 15, 26; 53/399, 589
See application file for complete search history.

(56) References Cited

U.S. PATENT DOCUMENTS 1,507,376 A 9/1924 Hintz
2,921,423 A * 1/1960 Cover et al. ..... 53/526
3,266,412 A 8/1966 Rodenbusch
3,352,228 A 11/1967 Hill
3,633,492 A 1/1972 Gilvar
3,822,526 A * 7/1974 Black ..... 53/529
3,955,491 A * 5/1976 McMahon ..... 100/7
4,006,678 A * 2/1977 Laurie et al. ..... 100/1
4,858,415 A 8/1989 Hake
5,092,106 A 3/1992 Doster et al.
5,259,325 A 11/1993 Pilger
5,427,022 A * 6/1995 Gardner ..... 100/214

FOREIGN PATENT DOCUMENTS

GB 166 747 7/1921
GB 1 091 151 11/1967

* cited by examiner

*Primary Examiner*—Jimmy Nguyen
(74) *Attorney, Agent, or Firm*—Buchanan Ingersoll & Rooney PC

(57) ABSTRACT

Tires are packaged in a stack by positioning the tires on a packaging device having a set of parallel alignment rollers such that the rollers contact the treads of the tires to orient the tires as a stable stack, with the respective center axes of the tires being substantially parallel to the axes of the rollers. At least one of the rollers is rotated to rotate all of the tires in the stack about their respective center axes to align the center axes of all of the tires with a longitudinal axis of a cylinder defined by the stack. After stopping the rotation, the stack is compressed in the axial direction while the alignment of the tire axes with the cylinder axis is maintained. One or more bands are then wrapped around the stack while maintaining the compression. Then the compression is released to release the stack which remains restrained by the bands.

5 Claims, 3 Drawing Sheets

PACKAGING OF TIRES IN HIGH STACKS

The present application claims priority under 35 U.S.C. §119 to Patent Application Serial No. 03/14963 filed in France on Dec. 17, 2003.

BACKGROUND

The present invention concerns the technical sector of the packaging of tires which are not mounted on rims, also referred to as tire covers, with a view to transporting or storing the tires.

The incessant search for gains in productivity, coupled with a constant desire to improve the working conditions of operators in this sector, has lead the various players in the industrial sector concerned to optimize the logistic chain by acting on the storage conditions in industrial warehouses, the transport, the loading and unloading operations and on the production of easily identifiable and movable batches in line with the delivery requirements or the requirements for optimization of the storage areas. These optimizations must also not be prejudicial to the integrity of the tires.

A first solution consists of using specially sized pallets for being able to receive covers of varied dimensions and diameters. By way of example, a pallet commonly used in storage warehouses is described in the application U.S. Pat. No. 5,259,325, in which the covers (unmounted tires) are stored in a stack or in a roll. Pallets of this type have the advantage of constituting homogenous batches of covers, of being able to be disposed on top of each other over great heights, of being able to be manipulated by mechanical means of the fork lift truck type, and of offering good protection for the covers against external attacks. They are, on the other hand, less adapted to transport, in particular over long distances, because of the small number of tires which they contain having regard to their bulk, and the management of the returns of empty pallets.

For transporting over long distances, it will be sought to make the largest number of covers enter a given volume, which may equally well be a lorry trailer, a maritime container, or a railway wagon.

Another solution commonly used consists of disposing the covers on top of each other with a particular arrangement known as a "fish bone" and putting the volume thus formed under compression so as to optimize loading. These methods are described, by way of example, in the patent U.S. Pat. No. 5,092,106. Very effective for optimizing the volume to be loaded, they do, nevertheless, have the drawback of having to be produced partly manually, in particular during unloading operations, which is a limiting factor from the ergonomic point of view because of the size and weight of the covers which it is possible to manipulate. In addition, this solution proves to be particularly inefficient in a storage warehouse because of the difficulty in handling and moving the batches thus produced, because it imposes a break in packaging in the logistic chain upstream and downstream of the transport operation, and because it is liable to cause mixing, should several sizes of cover be packaged in the same load. Finally, it is not without effect on the integrity of the tires because of the deformations which the latter may undergo.

To this end it is remarkable to find that each of the solutions mentioned above represents an optimum solution for a particular field, such as storage or transport, but rarely does the same technical solution prove to be advantageous over the entire logistic chain. This results in introducing addition handlings, which partly ruin the gains achieved by the choice of the solution most adapted to a particular point in the said chain.

This is the reason why intermediate solutions have been developed for the purpose of finding an overall optimum. One of these solutions consists of packaging the envelopes in stacks, consisting in general of around ten covers disposed on top of each other so as to form a cylinder with a vertical axis whose external surface is formed substantially by the treads of each of the covers.

This solution has the advantage of forming homogeneous handling batches which can easily be manipulated using adapted means. It thereby affords an advantageous compromise for optimizing the logistic chain over all the operations in the logistic chain, such as warehousing, the loading and unloading operations, and also transport, particularly for large covers which are difficult to manipulate manually, and proves particularly well adapted when the transport is carried out in several stages.

Once the stack is formed, the covers in the stack can be fixed together by a tie or strap as proposed in British Patent GB 166,747 or U.S. Pat. No. 1,507,376, by a shrink film as described in the U.S. Pat. No. 4,858,415 or remain under the sole action of their own weight.

Industrial machines, of the type proposed by the U.S. Pat. No. 3,955,491, have been developed to form stacks automatically in a first step, and then secondly disposing one or more holding straps.

According to the size of the covers, it is possible to dispose one or more stacks side by side on a flat pallet, generally non-recoverable, so as to optimize the size of the handling batches, or to treat the stack independently.

However, the optimization of these solutions is partly related to the number of covers which it is possible to join together within the same stack and consequently the maximum height of the stack.

In particular, it may prove particularly advantageous to produce stacks whose height corresponds to the height of the volume used for transport, and the increase in height of the trailers used in road transport results in wishing to use stacks of great height. "Great height" means heights which may commonly range up to 3 m, or even more, in certain particular cases.

It is found that these stacks are particularly tricky to manipulate in the absence of means for fixing together the covers which make them up, because of the risk of possible falling of one or more covers during handling. Moreover, it is also found that, under the action of their own weight or under the action of the tension of the straps, these stacks have an annoying tendency to deform and to exhibit a vertical projection of their centre of gravity which is very off centre with respect to the centre of their support base, consisting in this case of the contact of the first tire in the stack with the ground, and then leading to an instability of the stack and a high and unacceptable risk of falling over.

The object of the invention is to reduce these drawbacks.

SUMMARY OF THE INVENTION

Thus it has been shown that a precise alignment of the axes of the covers constituting the stack, prior to any compression operation, makes it possible to obtain cylindrical stacks having very substantial vertical axes, allowing the production of stacks of great height whose centre of gravity is projected substantially at the centre of the support base.

This precise alignment of the rotation axes of the tires is effected before putting the stack under compression and after having deposited the said tires on alignment rollers, by a rotation of all the tires intended to constitute the stack. By proceeding thus, the contact areas between the sidewalls of two adjacent tires are adjusted in pairs so that their rotation axes are precisely aligned, and all the radial stresses located at these interfaces and liable to subsequently deform the stack are released.

The method of packaging tires in a stack then comprises the following steps:

disposing the tires of the same size and intended to constitute a stack on a packaging device comprising a set of alignment rollers, mounted for rotation about axes parallel to each other, each of the rollers being intended to come into contact with the treads of each of the said tires so as to hold the latter in a stable fashion, the rotation axis of the tires being substantially parallel to the axis of the alignment rollers, then rotating at least one of the rollers, so as to rotationally drive all the tires intended to constitute the stack about each of their respective rotation axes until the rotation axes of each of the tires is precisely aligned with the rotation axis CC' of the cylinder formed by the stack thus formed and whose generatrices are tangent to the tread of each of the tires, and parallel to the axis of the alignment rollers, stopping the rotation of the alignment rollers, compressing the stack in the axial direction using a compression means whilst keeping the alignment produced in the previous step, disposing restraint means along the generatrices of the said cylinder, for holding the stack under compression, and releasing the action of the compression means in order to release the stack.

discharging the stack.

The device for implementing this method comprises alignment means, means of putting the stack of tires under compression and means of positioning restraint means, and is characterized in that the alignment means consists of at least two alignment rollers mounted for rotation about axes parallel to each other, each of the rollers being intended to come into contact with the treads of each of the said tires so as to hold the latter in a stable fashion, at least one of the rollers being able to drive all the tires in rotation about their respective rotation axes.

The alignment rollers can be disposed horizontally or, according to a variant embodiment, vertically.

BRIEF DESCRIPTION OF THE DRAWINGS

The following description sets out to give a non-limiting example embodiment of the equipment whose use is in accordance with the invention, relying on the figures, in which.

DETAILED DESCRIPTION OF PREFERRED EMBODIMENTS

Figure 1:
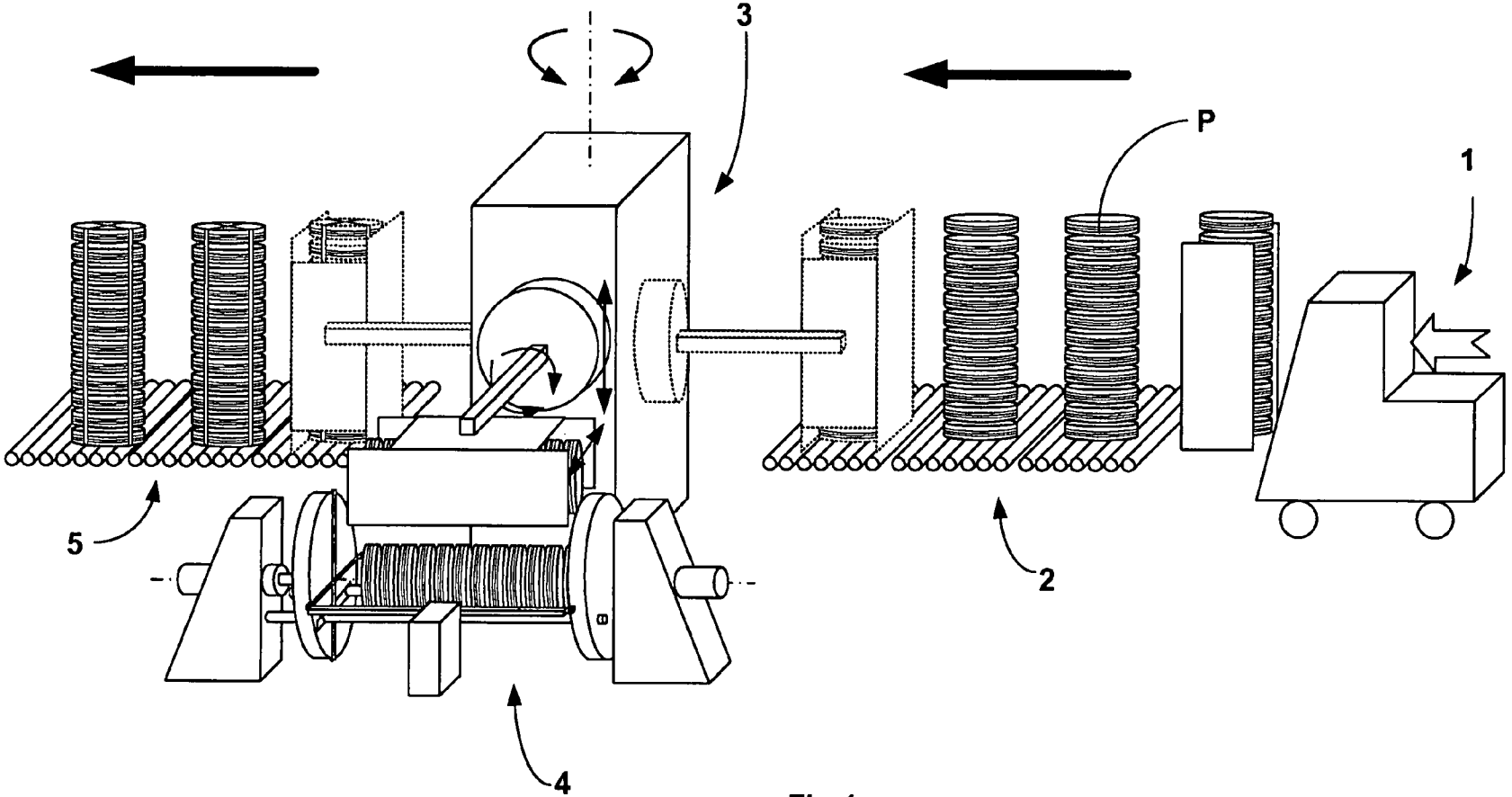
FIG. 1 depicts a schematic view of an industrial layout comprising a packaging device according to the invention.
Figure 2:
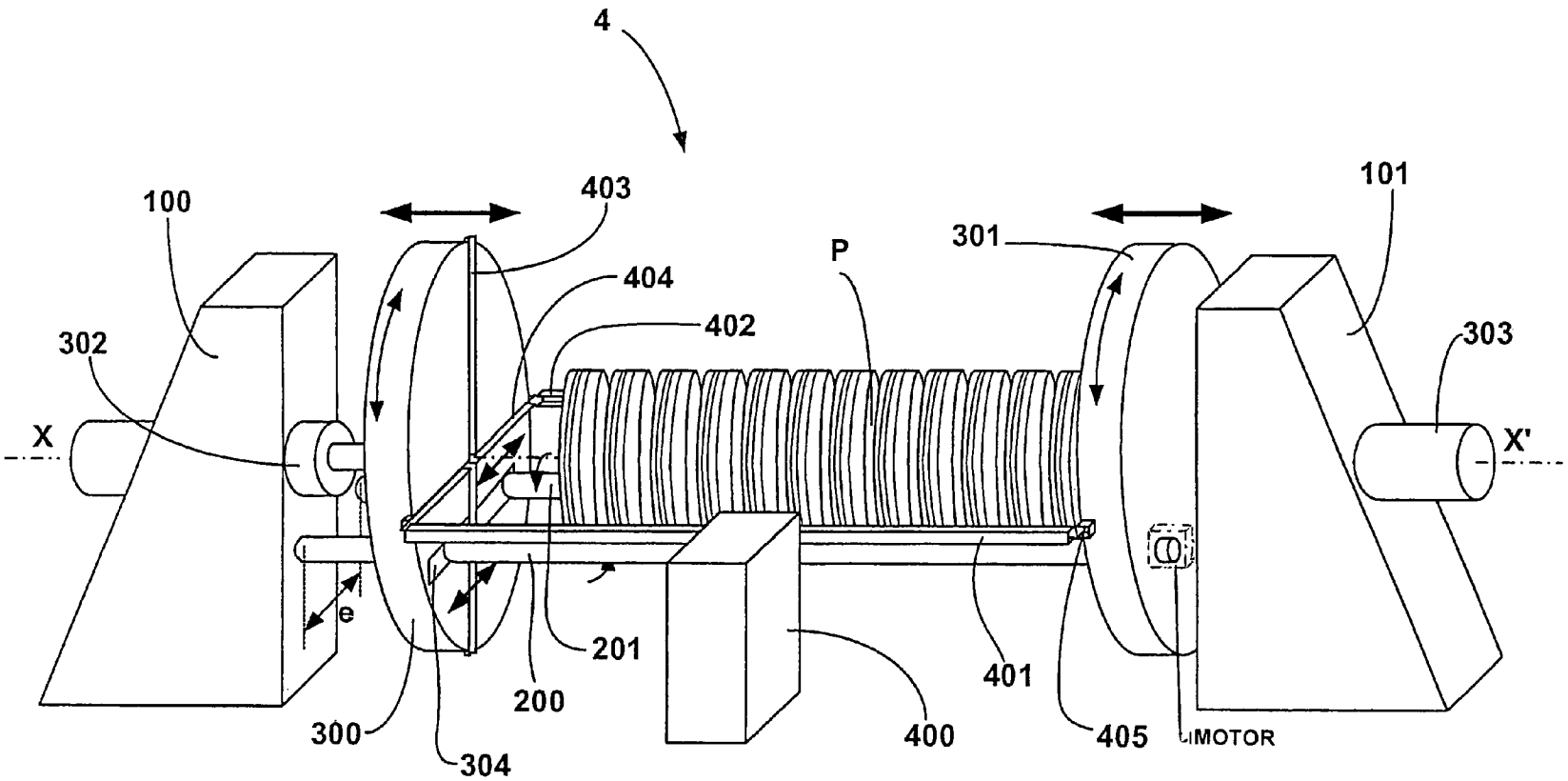
FIG. 2 depicts a schematic view of a packaging device according to the invention.

Hereinafter, the elements of the equipment having identical functions, as depicted in FIGS. 1 to 3, will be designated by the same reference numerals.

FIG. 1 presents a general schematic view of the production process in which the packaging machine is integrated. A lift truck 1 brings the tires packaged in vertical stacks P onto a supply belt 2. By "tires" is meant tires not mounted on rims, also referred to as tire covers.

A loading and turning-over device 3 grips the stack P and deposits it in the packaging device 3.

It should be noted, as described in detail hereinafter, that this packaging device is disposed horizontally and that it is therefore necessary to make the rotation axis of the covers pivot so as to bring them into the horizontal position.

Moreover, when the stack to be packaged represents an excessively large number of covers for their stability to be controllable during the upstream transfer operations, it is entirely possible to introduce the covers into the packaging device 4 in several loading operations.

Once the packaging operation has been executed on the packaging device 4, the same device 3 serves to extract the stack P and, after rotation, to dispose it on the discharge belt 5.

FIG. 2 depicts a schematic view of a packaging device 4 according to the invention, and configured in the following manner.

A frame 100, 101 supports a horizontal axis XX' on which the two compression plates 300 and 301 are disposed. These plates are able to move in translation along the axis XX' under the action of the rams 302 and 303, and in rotation about the axis XX' by means of a drive motor (not shown).

The compression plates support two alignment rollers 200 and 201 whose axes are parallel to each other and form a substantially horizontal plane. They are disposed symmetrically with respect to a vertical plane passing through the axis XX'.

The rollers 200 and 201 are mounted for rotation, and one of these rollers is provided with a drive motor. The other roller can also be provided with a drive for driving it in rotation or be simply free to rotate about its axis.

The rollers 200 and 201 are also able to move in the horizontal plane and their ends move in slots 304 so that it is possible to vary their separation "e" according to the size of the tire to be packaged.

The means of positioning the restraint means uses a technology which is widely commercially available, and consists of a fixed station 400 in which there are disposed a heat sealing strap dispenser, a traveling strapping head and a tensioner and a heat-welding and cutting tool (not shown). Guide rails 401, 402, 404 and 405 are disposed on a substantially horizontal plane passing substantially through the axis XX' and through the equator of the stack and form a rectangular parallelepiped surrounding the stack P. The rails 404 and 405 are disposed in the compression plates 300 and 301. It is thus possible, using the strapping head, to make the strap travel along the rails 401, 404, 402, and 405 and then, by means of the tensioner, to put the strap under tension by applying a calibrated force which will have the effect of releasing the strap from the rails and pressing it against two diametrically opposed generatrices of the stack and on the flanks of the two tires situated at the two ends of the stack. The strap is then cut and the two ends are welded.

A restraint means of this type is sold by way of example by the company Delonca under the trade name Jumbo.

The use of the device comprises a series of steps which will make it possible to clarify the functions of each of the components described above.

In a first step the tires are deposited on the alignment rollers 200, 201, arranging the rotation axes (center axes) of the tires in a direction substantially parallel to the alignment rollers.

The number of tires intended to constitute the stack is carefully determined so that the height of the stack once formed is substantially equal to the height of the most commonly used transport means. This height varies commonly from 2.5 m to 3 m according to the type of standard used by the logistics and may in certain cases range up to 3.5 m. Care will be taken to subtract the clearance necessary for performing the loading and unloading operations by mechanical means. The length of the rollers 200, 201 and the spacing between the compression plates 300, 301 will be determined accordingly.

It is then necessary to take account of the degree of compression required for ensuring the cohesion of the stack once strapped.

Determined experimentally, this degree of compression varies from 10 to 15% according to the dimensions. The criteria for determining the optimum degree take into account:

- the compression necessary for ensuring the cohesion of the stack P throughout all the subsequent handling operations; ensuring that at no time can sliding occur between the sidewalls of the tires and then destroy the coaxiality of the stack with the consequence of introducing an imbalance factor when the stack is stored vertically,
- the deformations under stress (temporary) of the covers and principally the deformation of the tires situated at the two ends of the stack.

It proves particularly useful, as will be seen below, to make the axis of the stack correspond with the rotation axis XX' of the compression plates 300, 301, so as to ensure there is as even a positioning of the restraint means as possible. By judiciously preadjusting the separation "e" between the rollers 200 and 201 according to the size to be packaged, it is ensured that the axes of the tires and the axis of the stack will be substantially aligned with the axis XX'.

Resting through two generatrices of their tread on the alignment rollers 200, 201, it will be remarked that, in this arrangement, the tires are held in a stable fashion because their centers of gravity are situated substantially on a vertical plane passing through the axis XX' and between the alignment rollers 200 and 201.

Before the alignment operation proper, it may prove useful to re-form the stack and position the tires in as even a manner as possible. To this end the compression plates 300, 301 will be brought together a first time so as to cause a slight compression of the stack and then the pressure will be released by positioning the plates as close as possible to the point of last contact between their respective internal faces and the sidewalls of the tires situated at the two ends of the stack.

The rotation of one of the alignment rollers will cause the rotation of each of the tires about its rotation axis. The effect of this overall movement is to precisely align each of the tires with respect to each other and to ensure that the rotation axis of each of the tires merges with the longitudinal axis CC' of a cylinder formed by the stack thus formed and whose generatrices are tangent to the tread of each of the tires, and parallel to the axis of the alignment rollers 200, 201, in order to obtain the maximum required concentricity. It is the precision of this alignment, combined with the compression in order to preserve the effects thereof, which procures the required stability for the stack.

This operation is completed after having made the stack of tires perform a small number of turns; around ten turns seems experimentally to give satisfaction.

Once the alignment is obtained it is necessary to compress the stack and to bring together the two compression plates 300, 301.

It should be remarked, however, that it may be particularly advantageous, once this alignment operation is performed, to prevent the tires from losing their alignments by lack of axial cohesion. This is the reason why it was suggested above to position the compression plates 300, 301 as close as possible to the external faces of the tires situated at the two ends of the stack.

However, so as to avoid any friction which may occur during the phase of alignment between the internal face of the compression plates and the external sidewalls of the two tires situated at the two ends of the stack and liable to impair their correct alignment, it is particularly advantageous to provide the internal face of the said plates with devices assisting sliding. This device may consist of a film of material with a low resistance to friction such as a film of polytetrafluoroethylene or a set of bearings.

The compression of the stack is effected by axially actuating the rams 302, 303 and moving the plates 300, 301. It may prove judicious to compress the stack to a value slightly greater than the final value desired so as to take account of the elasticity of the straps.

Care will be taken during this operation not to compromise the alignment achieved during the previous step.

Once the stack is put under compression and held between the two plates 300, 301, it is then possible to dispose the restraint means so as to clamp the movements of the stack in the axial direction. In order to ensure the best evenness of the clamping of the stack, it is recommended to dispose at least two straps so that the outlines of the straps on the sidewalls situated at the two ends of the stack delimit substantially equal sectors. Thus two straps will be disposed with an angle of 90° three straps with an angle of 60° and possibly four straps with an angle of 45°.

Care will be taken that this strap installation tension is constant.

It also proves to be particularly advantageous to be able to turn the stack about its axis CC' so as to dispose the restraint means in as even a manner as possible. To this end, the simultaneous rotation of the plates turning about the axis XX', substantially merged with the axis CC' of the stack, makes it possible to dispose the stack at as many angular positions as there are restraint means to be positioned, whilst keeping the stack under compression in order to prevent any radial movement of the tires with respect to each other. To this end the plates 300, 301 each comprise as many sets of rails as necessary to ensure the continuity of the guidance of the strapping head, that is to say, in the configuration serving as a support for this description, two rails disposed at 90°, 403, 404, 405. In the case it is desired to dispose three straps, it should be convenient to realize on each plate 300, 301, three rails disposed at 60°.

The choice of the straps 407 (FIG. 3B) is adapted according to the size to be packaged. Namely that the width and thickness will be determined according to the stresses undergone by the strap, but also according to the pressure which it is possible to exert on the sidewalls of the tires situated at the two ends of the stack without causing permanent deformations. Thus a 25 mm strap will be chosen for a size of the private car type and a 35 mm strap for a size of the heavy goods vehicle type.

The strap can consist of a flexible material such as polyester, polyamide or polyethylene. Metallic ties can possibly be used in the heavy goods vehicle size for preference.

Once the restraint means are fastened, the plates 300, 301 for putting the stack under compression are returned to their initial angular position and by distancing the said compression plates the stack P is released, which it is then possible to discharge with an unloading means 3 and to replace in a vertical position.

The stack thus formed has sufficient internal cohesion to be able to undergo all subsequent handlings without harmful changes.

Figure 3B:
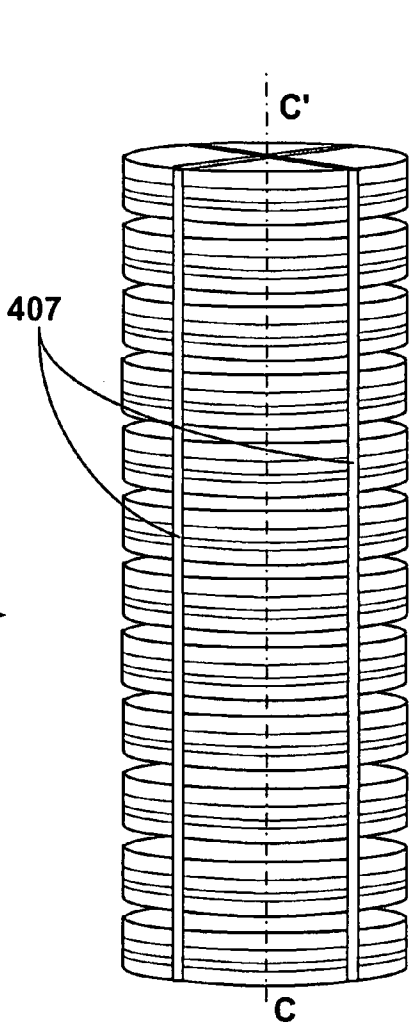
FIG. 3*b* depicts a schematic view of a stack of tires produced with a method of packaging tires in a stack according to the invention.
Figure 3A:
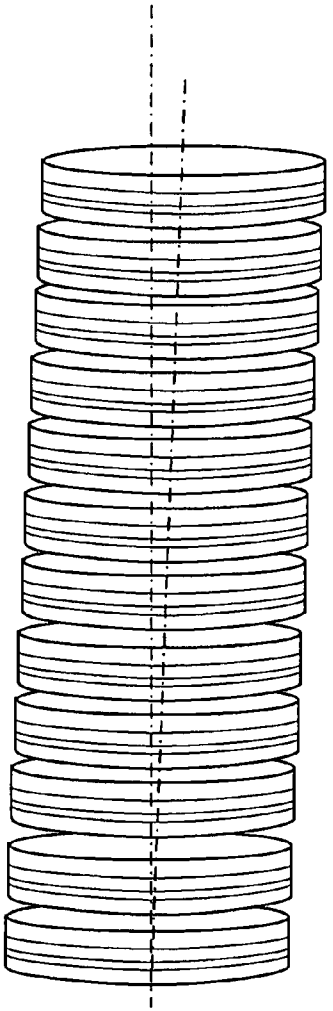
Fig. 3a (PRIOR ART)
FIG. 3*a* depicts a schematic view of a stack of tires produced with a traditional method.

FIGS. 3A and 3B depict a stack as obtained with traditional means (3A) and a stack obtained with the method as described above (3B).

The configuration of the device which served as a support for the description of the invention corresponds to a preferential embodiment. It should be noted nevertheless that it is possible to propose equivalent embodiments whilst remaining within the scope of the teachings proposed by the present invention.

A person skilled in the art will thus be able to adapt the device without difficulty so as to dispose the two alignment rollers 200, 201 horizontal and parallel to each other but forming a plane making an angle with the horizontal.

Likewise, whilst keeping the alignment rollers horizontal and parallel to each other, it is possible to arrange a device comprising three rollers or even more.

Another configuration consists of disposing the rollers vertically, which may constitute an advantage in terms of handling and organization of the packaging workshop.

In this context it is necessary to use at least three alignment rollers so as to grip the stack to be packaged in a stable fashion. These rollers will be disposed so that the line of the intersection of the axes of the alignment rollers with a horizontal plane forms a substantially regular polygon. It will be necessary to provide a mechanism for bringing in and withdrawing the rollers in the radial direction so as to release a space for introducing and extracting the tires from the alignment device. Finally, the restraint device will be positioned accordingly.

In this configuration it will also be necessary to adapt the radial pressure of the rollers On the treads of the tires so as to compel the latter to be aligned correctly in a radial direction whilst combating the friction forces existing between the sidewalls of each of the tires in the stack.

The choice of strapping passing through the diametrically opposed generatrices remains the best adapted embodiment. However, it is possible to produce strapping by making the strap pass along a line passing through an external generatrix of the stack, through the radial pathways adjoining this generatrix and situated on the flanks of the two tires situated at the two axial ends of the stack, and through the internal part of the stack. This makes it necessary to dispose a rail passing through the inside of the stack and to remove it at each end of the cycle, which is not without repercussion on the overall bulk and on the cycle time of the packaging device.

What is claimed is:

1. A method of packaging tires in a stack, the tires are not mounted on rims, the method comprising the steps of:

A. positioning the tires on a packaging device having a set of parallel alignment rollers, each of the alignment rollers is arranged horizontally such that the rollers contact treads of the tires to orient the tires as a stable stack, with respective center axes of the tires being substantially parallel to rotation axes of the rollers;

B. rotating at least one of the rollers by a drive motor to rotate all of the tires in the stack multiple turns about their respective center axes to align the center axes of all of the tires with a longitudinal axis of a cylinder defined by the stack;

C. stopping the roller rotation; then

D. compressing the stack in a direction parallel to the respective rotation axes of the rollers by at least one compression plate while maintaining the alignment of the tire axes with the cylinder axis, wherein the packaging device is configured to enable the at least one compression plate to move relative to the rollers in said direction;

E. arranging a stack-restraining structure around the stack while maintaining the compression of step D; and then F. releasing the compression to release the stack which remains restrained by the restraining structure.

2. The method according to claim 1 wherein the step of compressing the stack comprises compressing the tires such that a degree of compression of the tires is from 10% to 15%.

3. The method according to claim 1 wherein step the step of arranging a stack-restraining structure comprises arranging said stack-restraining structure in the form of a plurality of continuous straps.

4. The method according to claim 1 wherein the step of positioning the tires comprises positioning tires of identical size and configuration on the packaging device.

5. The method according to claim 1 wherein the step of arranging a stack-restraining structure comprises positioning a plurality of endless straps around the stack, each of the straps extending parallel to an axis of the stack at two diametrically opposed places along the tire treads which form part of the stack exterior, and along respective sidewalls of two end-most tires of the stack.

* * * * *